US006406404B1

(12) United States Patent
Chu

(10) Patent No.: US 6,406,404 B1
(45) Date of Patent: Jun. 18, 2002

(54) FACIAL MUSCLE EXERCISING DEVICE

(76) Inventor: Chia Chen Chu, 4350 Macronald Dr., La Mesa, CA (US) 91941

( * ) Notice: Subject to any disclaimer, the term of this patent is extended or adjusted under 35 U.S.C. 154(b) by 0 days.

(21) Appl. No.: 09/802,559

(22) Filed: Mar. 12, 2001

(51) Int. Cl.[7] ..... A63B 23/02
(52) U.S. Cl. ..... 482/11; 482/124; 482/128
(58) Field of Search ..... 482/10, 11, 124, 482/126, 128, 140, 112; 604/104, 105, 106, 107

(56) References Cited

U.S. PATENT DOCUMENTS

| | | | |
|---|---|---|---|
| 3,528,655 | A | 9/1970 | Ruderian |
| 3,938,508 | A | 2/1976 | Buckner |
| 4,196,902 | A | 4/1980 | Borriello |
| 4,280,695 | A | 7/1981 | Ramon |
| 4,671,260 | A | 6/1987 | Buckner |
| 5,556,357 | A | 9/1996 | Hanna |
| D397,173 | S | 8/1998 | Edell |
| 5,919,116 | A | 7/1999 | Edell |

FOREIGN PATENT DOCUMENTS

| | | |
|---|---|---|
| WO | PCTUS98/06750 | 5/1998 |

*Primary Examiner*—Jerome Donnelly
(74) *Attorney, Agent, or Firm*—Charles H. Thomas

(57) ABSTRACT

A facial muscle exercising device is designed for insertion between the lips of a person's mouth. The facial muscle exercising device is comprised of a pair of lip-engaging members disposed in longitudinal separation from each other. Each of these lip-engaging members has a convex outwardly curved side with a concave groove defined therein. A pair of the elongated, coaxially aligned telescopically engaged spreader members are urged apart by an axially compressible coil spring having opposing ends and disposed in coaxial alignment with the telescoping spreader members. A guide rod is provided and is anchored to one of the lip-engaging members. The free end of the guide rod extends through a guide passage in the other lip-engaging member. The guide rod is aligned parallel to the coaxial, telescoping spreader members.

17 Claims, 7 Drawing Sheets

FACIAL MUSCLE EXERCISING DEVICE

BACKGROUND OF THE INVENTION

1. Field of the Invention

The present invention relates to a device useful for exercising a person's facial muscles to improve muscle tone and enhance elasticity of the facial muscles.

2. Description of the Prior Art

It is well known of that as a person ages the facial muscles of an individual lose tone and elasticity and tend to sag. The loss of tone and elasticity of the facial muscles creates wrinkles and jowls on a person's face. This deterioration in facial muscle tone and elasticity very significantly detracts from the person's appearance and can cause loss of self esteem and even psychological depression.

To combat this effect of aging it is helpful to exercise the facial muscles in a way that prevents their loss of tone and elasticity. The normal facial movements of a person in speaking, chewing, smiling, frowning, and so forth do not achieve the required exercising of the correct muscles to a sufficient degree.

Various devices have been developed for the purpose of aiding a person in exercising the facial muscles to retain elasticity and prevent loss of muscle tone. These devices are held within the lips of a person's mouth and operated by pursing the lips together to overcome a spring bias. Conventional devices of this type are described in U.S. Pat. Nos. 4,671,260; 5,919,116; 5,556,357; 3,938,508; 3,528,655; 4,280,696; 4,196,902; Des. 397,173; and PCT/US98/06750. However, the conventional devices which have been developed for this purpose are uncomfortable to use and difficult to operate. As a consequence, while a person may use these conventional devices for a short time, they are very often set aside completely or utilized only sporadically.

SUMMARY OF THE INVENTION

The present invention involves a facial muscle exercising device that differs significantly in construction from conventional devices designed for the same purpose. The facial muscle exercising device of the present invention is comprised of a pair of end pieces, a pair of rigid tubes, and a coil spring. Unlike the devices of conventional systems, the end pieces of the facial muscle exercising device of the present invention have curved, convex outwardly facing opposing end sides that face away from each other, and opposing, longitudinally aligned sockets that face toward each other. The pair of rigid tubes includes a narrower diameter inner tube and a hollow, annular outer tube that receives the inner tube therewithin in coaxial, telescopic engagement therewith. The inner tube is seated in the socket of one of the end pieces and the outer tube is seated in the socket of the other of the end pieces. The coil spring is disposed in coaxial arrangement with the telescopically engaged tubes. The opposing ends of the coil spring bear against the end pieces to bias them apart from each other.

Due to its convex outwardly facing end surfaces, the facial muscle exercising device of the invention is far more comfortable to operate. The convex surfaces conform to the concave corners of the mouth where a person's lips meet as those corners are drawn toward each other in the pursing movements of the lips. Consequently, a user is not nearly so likely to tire of using the facial muscle exercising device of the invention as is the case with conventional prior devices.

Also, the arc of contact between the convex surfaces of the lip engaging pieces of the device of the invention is much greater than in conventional facial muscle exercising devices. For example, the arc of contact of the lip engaging pieces in U.S. Pat. No. 4,671,260 is only about 100 degrees. This limited arc of contact creates a large force concentrations on the users lips. Indeed, these force concentrations are large enough to her to the users lips, and even to crack them. By contrast, the outwardly, convex curved portion of each of the lip engaging pieces of the present invention extends all were on arc of at least 180 degrees up to about 250 degrees. In the preferred embodiment the arc of engagement is about 240 degrees. By spreading the force of the coil spring over a much larger arc in the lip engaging pieces of the present invention, force concentrations are greatly reduced and the device is much more comfortable to the user.

In one a broad aspect the present invention may be considered to be a facial muscle exercising apparatus comprising: a pair of opposing lip-engaging pieces having mutually facing inner surfaces and opposing convex outwardly curved outer surfaces, a pair of coaxial telescoping tubes each one of which is secured to a separate one of the inner surfaces of the pair of lip-engaging pieces, and a coil spring coaxially engaged relative to the telescoping tubes for compression between the inner surfaces of the end pieces to bias the end pieces apart from each other.

Preferably, longitudinally aligned concave grooves are defined in the concave outwardly curved outer surfaces of the lip-engaging pieces to receive the lips of a user at the corners of a user's mouth where the lips meet. This groove provides a seat for the users lips and helps keep the device from popping out of the users mouth.

Preferably also a guide passageway is defined through each of the lip-engaging pieces. These guide passageways are parallel to the alignment of the coaxial tubes. The passageway through one of the lip-engaging pieces has openings at the inner and outer surfaces thereof. The guide passageway opening at the inner surface is of reduced cross-sectional area from the opening at the outer surface. An internal abutment ledge directed toward the outwardly facing surface is thereby defined within the structure of this lip-engaging piece.

The device is further comprised of a guide member having a longitudinally elongated shank with opposing ends. The guide member is received within the guide passageways. The shank of the guide member has an enlarged lug at one of its ends, specifically the end which is disposed outboard from the abutment ledge defined in the lip-engaging piece in which the abutment ledge is formed. The other of the lip-engaging pieces has a releaseable locking member for engaging the other end of the guide member shank at a selected location along the length of the other end of the guide member shank.

The coil spring may be disposed externally about the telescoping tubes. Alternatively, the coil spring may be disposed coaxially within the surrounding confines of the telescoping tubes. In either arrangement, the ends of the coil spring bear against the inner surfaces of the two lip-engaging pieces either directly or through one or more spacer elements located between the spring and at least one of the lip-engaging pieces. Spacer elements can be used to adjust the force with which the lip-engaging pieces are biased apart by the coil spring.

The invention may be described with greater clarity and particularity by reference to the accompanying drawings.

DESCRIPTION OF THE EMBODIMENT

Figure 1:
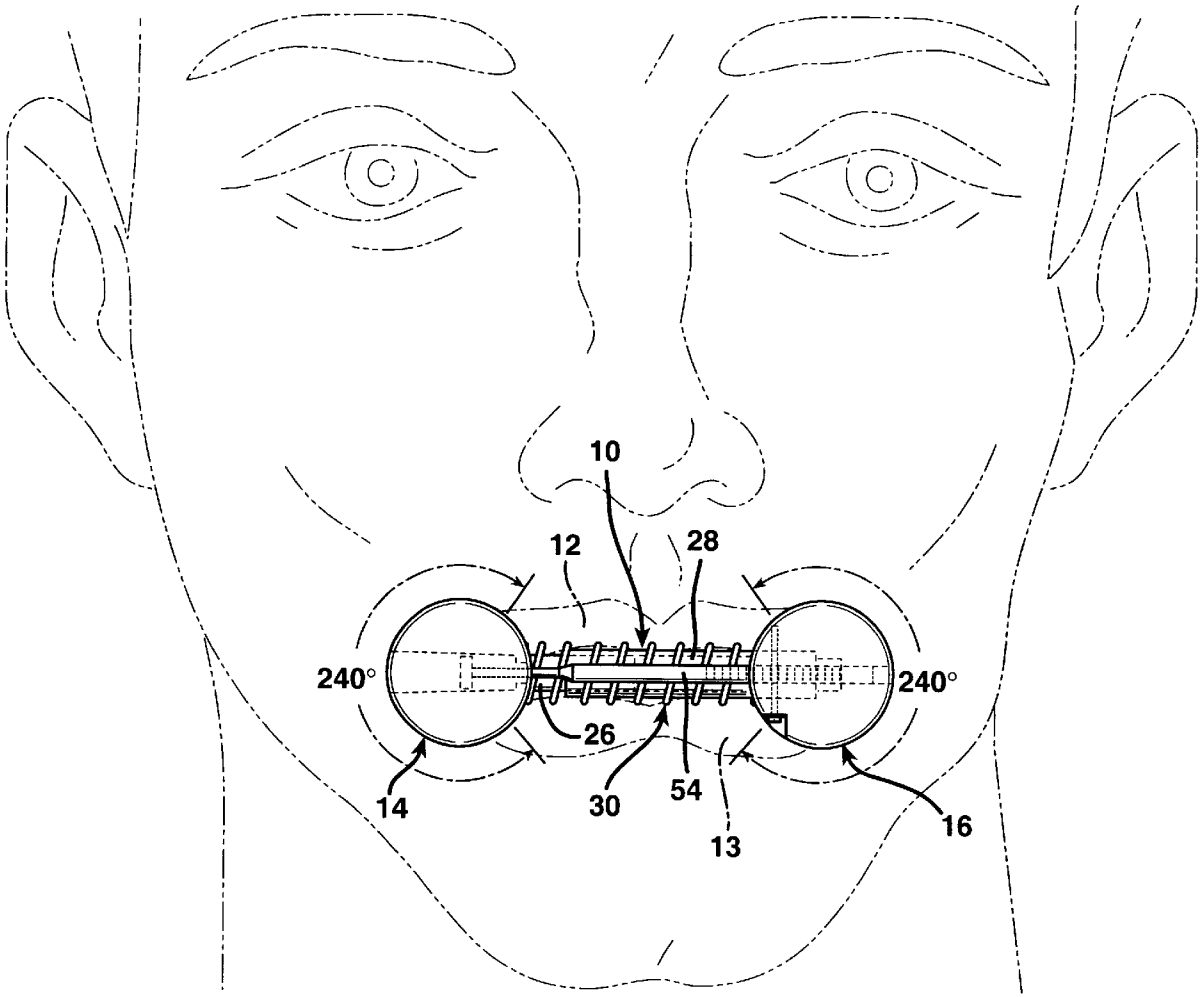
FIG. 1 is an elevational view illustrating the use of one preferred embodiment of the device positioned in the mouth of a user whose face is shown in phantom.

FIG. 1 illustrates a facial muscle exercising device indicated generally at 10 positioned for use in the mouth of a person whose upper lip is indicated at 12 and whose lower lip is indicated at 13. As illustrated, the facial muscle exercising apparatus 10 is designed for insertion between the lips 12 and 13 of the persons mouth.

The facial muscle exercising apparatus 10 is comprised of a pair of lip-engaging end piece members 14 and 16 which are disposed in longitudinal separation from each other and which have mutually opposing, convex outwardly curved sides 20 and opposite, mutually facing sides 22 in which longitudinally aligned, cylindrical-shaped sockets 24 are defined.

The facial muscle exercising device 10 is further comprised of a pair of coaxial, telescoping tubes 26 and 28, which may be formed of stainless steel or plastic. Each of the telescoping tubes 26 and 28 is secured to a separate one of the inner surfaces 22 of the pair of lip-engaging pieces 14 and 16. Specifically, the outer, hollow cylindrical annular tube 28 is seated in the socket 24 in the inner face 22 of the end piece 16 and is permanently secured in position to project from the end piece 16. The inner, hollow cylindrical tube 26 is seated in the socket 24 in the inner face 22 of the end piece 14. A coil spring 30 is coaxially engaged relative to the telescoping tubes 26 and 28 for compression between the inner surfaces 22 of the end pieces 14 and 16. The coil spring 30 operates to bias the end pieces 14 and 16 apart from each other.

Each of the end pieces 14 and 16 is formed of injection molded plastic and has a generally cylindrical configuration, with a segmental portion removed therefrom. Each end piece 14 and 16 is about one and five-sixteenths inches in diameter and about one and five-sixteenths inches in axial length. The cylindrical portion 32 of each end piece 14 and 16 that projects out from the users face, as illustrated in FIG. 1, is about 19/32 inches in axial length. Concave arcuate grooves 34, each about one-half of an inch wide and about 0.100 inches in depth, are defined in the outwardly facing, outboard sides 20 of the noncylindrical portions 36 of the lip-engaging pieces 14 and 16. The grooves 34 are aligned to extend parallel to the coaxial alignment of the telescopically engaged tubes 26 and 28 for the facial muscle exercising device 10. The plane of symmetry 35 of the grooves 34 is parallel to the mutual axis of alignment of the cylindrical inner and outer tubes 26 and 28, but is offset therefrom inwardly toward the throat of the user and away from the cylindrical portions 32 of the end pieces 14 and 16 a distance of about one-eighth of an inch from the parallel plane that contains the axis of alignment of the tubes 26 and 28.

An arcuate segment having a radial dimension of about five-sixteenths of an inch and an axial dimension of about one-half inch is removed from the mutually facing inner sides 22 of the end pieces 14 and 16, so that the surfaces of the inner sides 22 into which the sockets 24 are formed are flat, mutually parallel to each other, and are both perpendicular to the axis of alignment of the concentric, cylindrical tubes 26 and 28. The circumference of the convex, outwardly facing surface at the bottom of the trough of each of the grooves 34 extends over an arc of between about 180 degrees and about 250 degrees as measured in the plane of symmetry 35. In the preferred embodiment of the invention described this arc is about 240 degrees and contacts the lips 12 and 13 of the user throughout when the facial muscle exercising device 10 is utilized, as indicated in FIG. 1.

The sockets 24 are about five-eighths inches in diameter at the flat surfaces of the inner sides 22 in which they are formed. The inner end faces 40 of the noncylindrical portions 36 of the end pieces 14 and 16 are flat, but are not parallel to the outer circular faces 31 of the cylindrical portions 32 of the lip-engaging pieces 14 and 16. Rather, the inner end faces 40 of the lip-engaging pieces 14 and 16 are inclined slightly toward the coaxial tubes 26 and 28 so that each end piece 14 and 16 has an axial length, as measured along its outwardly facing sides 20 that is about one-sixteenth of an inch greater than the axial length measured at the inner edges of the flat surfaces of the inner sides 22.

At least one, and preferably both, of the lip-engaging pieces 14 and 16 has a guideway defined therein. In the embodiments illustrated, the guideway 42 defined through the lip-engaging piece 14 is a passageway 42 that extends through the cylindrical portion 32. The passageway 42 has a frustoconical configuration with circular openings 44 and 46 at the inner side 22 and outer side 20, respectively, of the cylindrical portion 32 of the lip-engaging piece 14. The opening 44 at the inner side 22 of the lip-engaging piece 14 is of reduced cross-sectional area of from the opening 46 at the outer side 20. The frustoconical passageway 42 narrows from a maximum diameter of about nine-sixteenths of an inch at the opening 46 to about seven-sixteenths of an inch, where it defines and annular abutment ledge 48 about one-eighth of an inch from the circular opening 44. The opening 44 is about five-sixteenths of an inch in diameter. The internal abutment ledge 48 is thereby directed toward the outwardly facing side 20 and is located within the cylindrical portion 32 of the lip-engaging piece 14.

The guideway formed in the lip-engaging piece 16 is a cylindrical passageway 50 defined in a transverse direction completely through the cylindrical portion 32 of the lip-engaging piece 16. When the components of the facial muscle exercising device 10 are assembled together the passageways 42 and 50 defined through the structures of the lip-engaging pieces 14 and 16, respectively, are coaxially aligned with each other in an alignment parallel to the mutually coaxial alignment of the tubes 26 and 28.

The facial muscle exercising device 10 is further comprised of a longitudinally elongated guide member which is a guide rod 54. The guide rod 54 has a shank 56 with an enlarged disc-shaped lug 58 at one of its ends. Adjacent to the disc-shaped lug 58 the shank 56 has a necked down region 60 of reduced diameter. The opposite end 62 of the shank 56 is about one-quarter of an inch in diameter and has a plurality of closely spaced, transverse catch recesses which are formed as locking openings 64 defined entirely through the structure of the end 62 of the shank 56 at closely spaced, longitudinally separated intervals. The transverse openings 64 are preferably about one-sixteenth of an inch in diameter and are spaced approximately one-sixteenth of an inch apart.

The guide rod 54 is received within the guide passageways 42 and 50 with the enlarged lug 58 disposed outboard from the abutment ledge 48 so that the necked down portion 60 of the guide rod 56 passes through the opening 44 in the inner side 20 of the lip-engaging piece 14. The opposite end 62 of the shank 56 of the guide rod 54 extends into the cylindrical passageway 50 defined through the structure of the lip-engaging piece 16.

A notch 66 is defined in the cylindrical portion 32 of the lip-engaging end piece 16 so as to form a flat surface recessed inwardly from the cylindrical portion 32 of the lip-engaging piece 16. This flat surface serves as a bearing surface against which the underside of the head of a set screw 68 bears. The set screw 68 is a releaseable locking member that has a threaded shank which is threadably engaged in an internally tapped bore defined in the portion 32 of the lip-engaging piece 16. When the set screw 68 is fully advanced into this internally tapped bore, the underside of its head resides in contact with the flat surface formed by the notch 66. At the same time the tip of the shank of the set screw 68 extends through a selected one of the openings 64 defined through the structure of the shank 56 of the guide rod 54 at the end 62 thereof. Once the set screw 68 is engaged in a selected opening 64, the guide rod 56 is secured to the lip-engaging piece 16 and the set screw 68 serves as a releaseable locking member for engaging the other end 62 of the guide rod 54, remote from the end bearing the enlarged lug 58.

To vary the maximum stroke of the guide rod 54 relative to the lip-engaging piece 14 and to adjust the preload compressive force on the coil spring 30, the set screw 68 may be withdrawn and the shank 56 adjusted longitudinally within the passageway 50 to a desired position. The set screw 68 is then reengaged so that its shank projects into a different selected catch opening 64. The locking set screw 68 may thereby releaseably engage the guide rod shank 58 at a selected location along the length of the end 62 of the guide rod shank 56.

Figure 2:
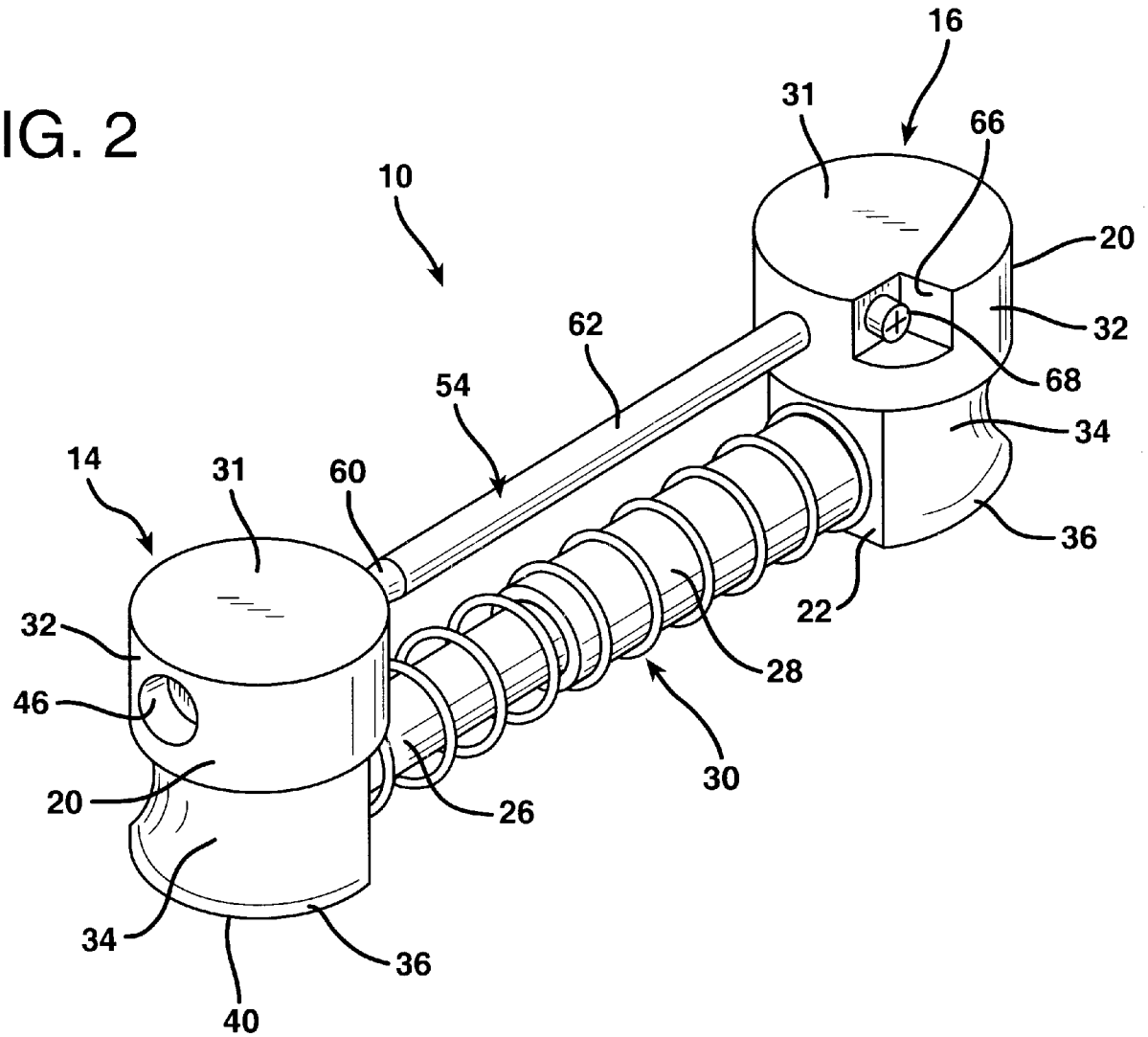
FIG. 2 is a perspective view of the embodiment of the facial muscle exercising device shown in FIG. 1.
Figure 6:
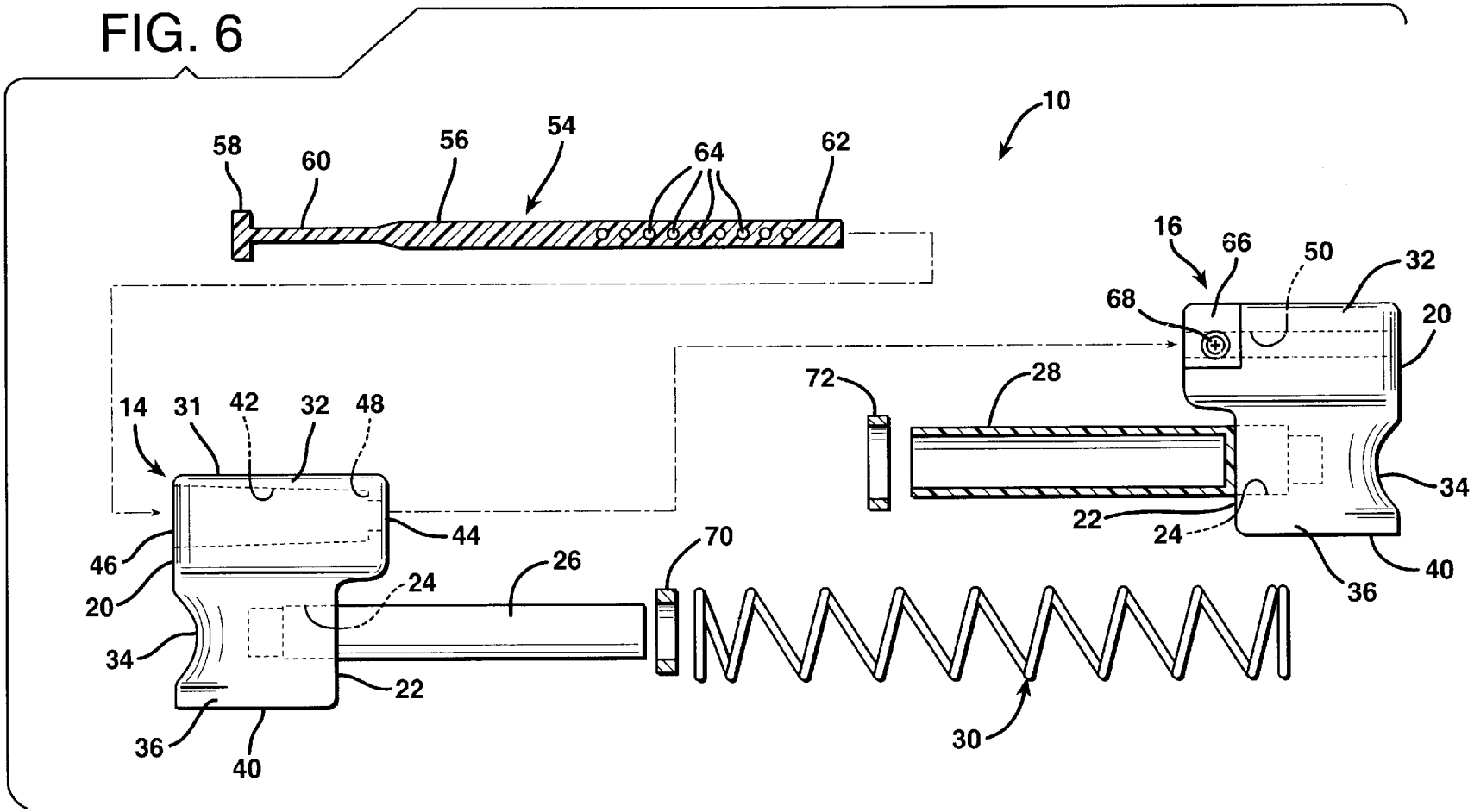
FIG. 6 is an exploded view illustrating the component parts of the muscle exercising device shown in FIG. 2.

The coil spring 30 is disposed coaxially about the outermost hollow cylindrical end 28. When compressed to its extended length in the condition illustrated in FIG. 2, it exerts a pressure of between about five or six pounds and about 20 pounds, preferably about 12 pounds "safe load". The spring 30 is held in compression in its extended condition since the distance between the portion of the guide rod 54 between the catch opening 64 in which the set screw 68 is engaged and the enlarged lug 58 is slightly shorter than the longitudinal length of the spring 30 in its fully expanded and relaxed condition. The spring 30 is maintained under some compression, even in the extended position of FIG. 2 since the abutting engagement of the enlarged lug 58 with the bearing ledge 48 prevents the spring 30 from expanding to its fully expanded, completely relaxed condition illustrated in the exploded view of FIG. 6.

Another way of providing adjustments to the compressive force exerted by the spring 30 involves the use of spacing washers 70 and 72. The inner diameter of the spacing washer 70 is selected to allow it to smoothly slide over the outer surface of the inner telescopic tube 26, while the inner diameter of the spacing washer 72 is selected so that it may be disposed coaxially and removably about the outer surface of the outer telescoping tube 28. The use of spacing washers 70 and/or 72 increases the preload compressive force exerted by the spring 30 pushing the lip-engaging pieces 14 and 16 apart from each other.

To utilize the facial muscle exercising device 10 the user first selectively adjusts the effective length of the shank 56 of the guide rod 54 by inserting the end 62 of the shank 56 through the passageway 42 and into the longitudinally outlined passageway 50 of the end piece 14 with the coil spring 30 disposed coaxially about the outer tube 28 while the tube 28 is coaxially aligned with the inner tube 26. The end 62 of the guide rod shank 56 is inserted into the passageway 50 of the end piece 16 while the set screw 68 is at least partially retracted. Once the lug 58 is pulled into abutment against the bearing ledge 48 and the user is satisfied with the effective length of the guide rod shank 56, the user aligns the internally tapped bore in the notched out portion 66 of the lip-engaging piece 16 and advances the set screw 68 into engagement with the selected catch opening 64. A compressive preload thereupon exists in the spring 30 tending to bias the lip-engaging pieces 14 and 16 apart. The facial muscle exercising device 10 is thereby in the extended, preloaded condition illustrated in FIG. 3.

When assembled and adjusted the coaxial tubes 26 and 28 have a common, straight linear axis of alignment. The end of the guide rod 54 bearing the enlarged lug 58 is a free end and the opposite end 62 of the guide rod shank 56 is an anchored end. The guideway passage 42 defined in the lip-engaging member 14 receives the free end of the guide rod 54 in reciprocal engagement therewith. The set screw 68 serves as a catch mechanism in the other lip-engaging piece 16. This catch mechanism in the lip-engaging piece 16 is releaseably engageable with the anchored end 62 of the guide rod shank 56 at different locations along its length.

The user then places the facial muscle exercising device 10 in his or her mouth with the cylindrical portions 32 of the lip-engaging pieces 14 and 16 directed outwardly from the user's face as illustrated in FIG. 1. In this condition the opposing lip-engaging pieces 14 and 16 reside in alignment with each other with the grooves 34 in the two end pieces 14 and 16 residing in a common plane parallel to the axis of the telescoping tubes 26 and 28. The corners of the user's mouth between the upper and lower lips 12 and 13 are engaged in the grooves 34 and in contact with the outwardly facing sides 20 of the lip-engaging end pieces 14 and 16.

The user then contracts the facial muscles to purse the lips 12 and 13 together, thereby drawing the corners of the mouth closer to each other. To do this the user's facial muscles must overcome the compressive force exerted by the coil spring 30 which acts in opposition to the user's facial muscles. The coaxial, telescoping tubes 26 and 28 serve as spreader members. The user thereupon relaxes the facial muscles, thus allowing the coil spring 30 to again push the lip-engaging pieces 14 and 16 apart from each other. As the coil spring 30 expands longitudinally, the end piece engaging lug 58 at the end extremity of the guide rod shank 56 is brought into abutment against the bearing ledge 48 of the lip-engaging member 14 when the coil spring 30 forces the lip-engaging pieces 14 and 16 to a maximum distance of separation from each other.

Figure 3:
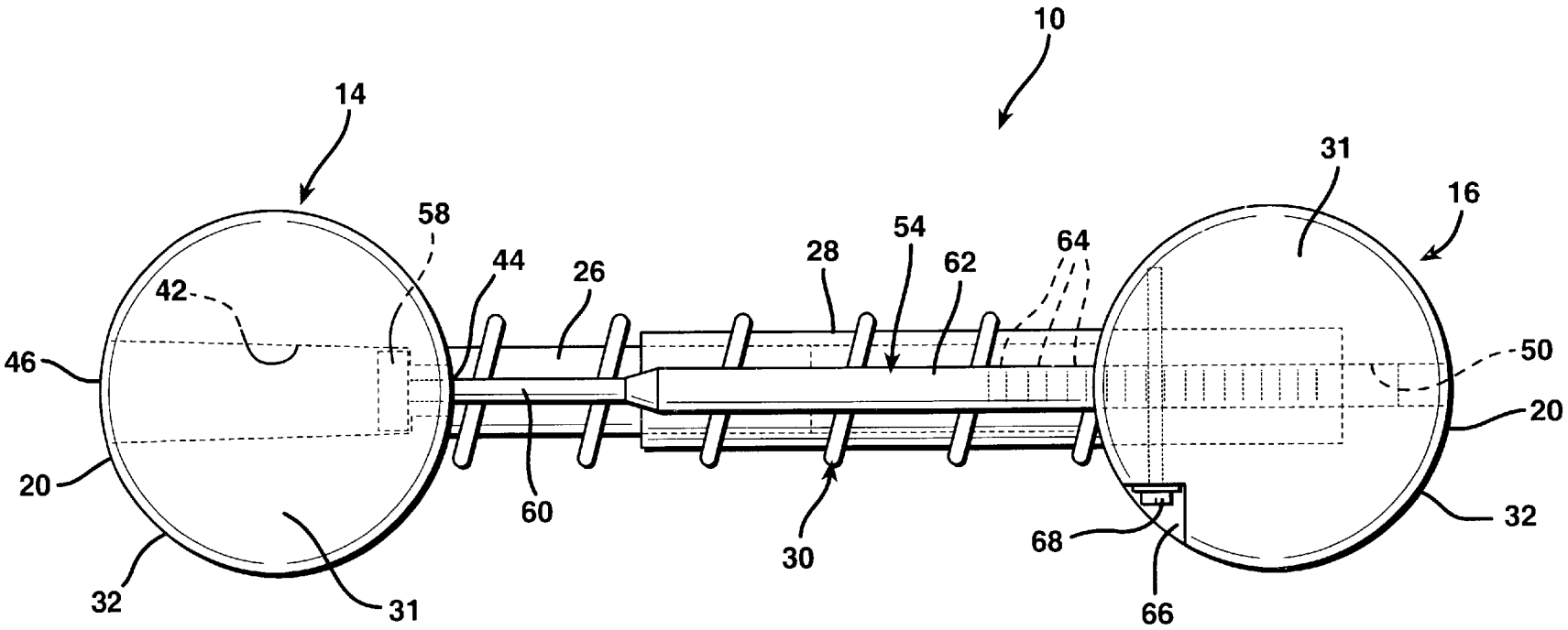
FIG. 3 is a top plan view of the facial muscle exercising device of FIG. 2 shown in an extended condition.
Figure 4:
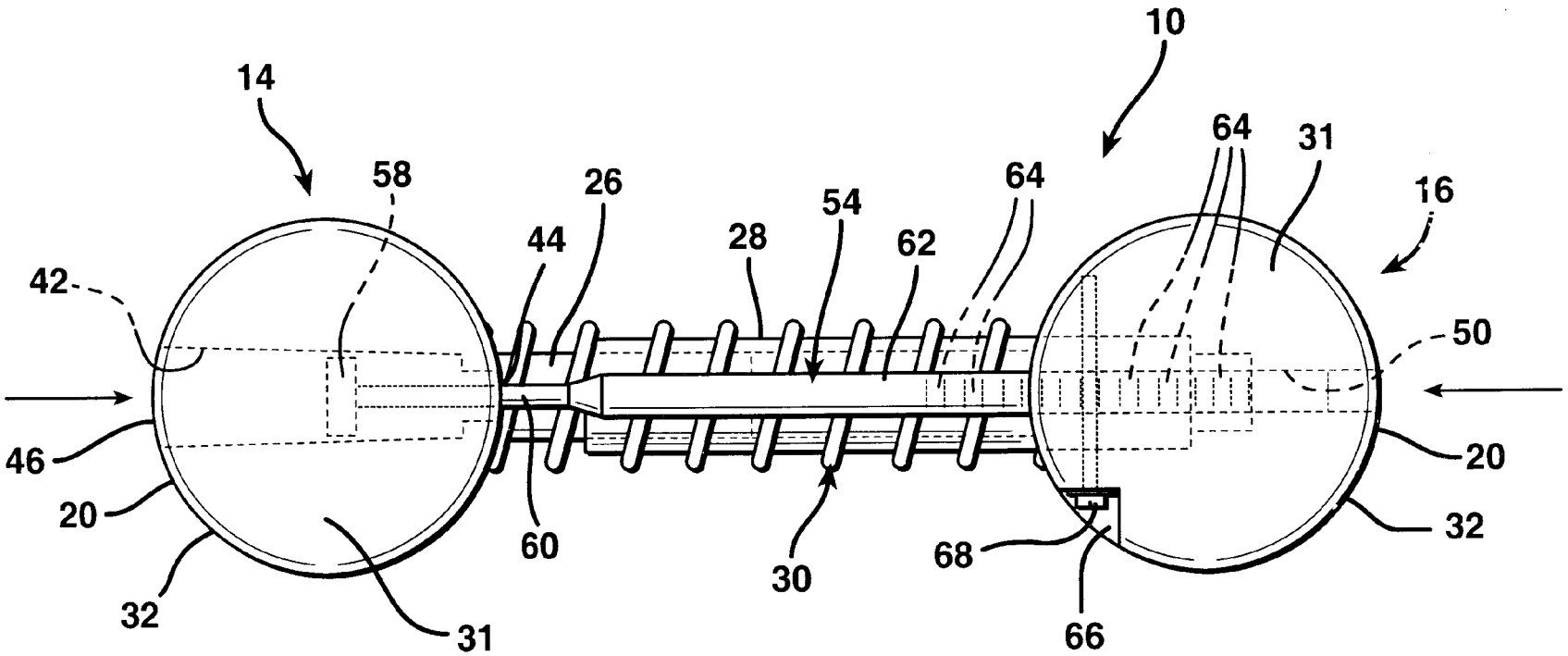
FIG. 4 is a top plan view of the facial muscle exercising device of FIG. 2 shown in a contracted condition.
Figure 5:
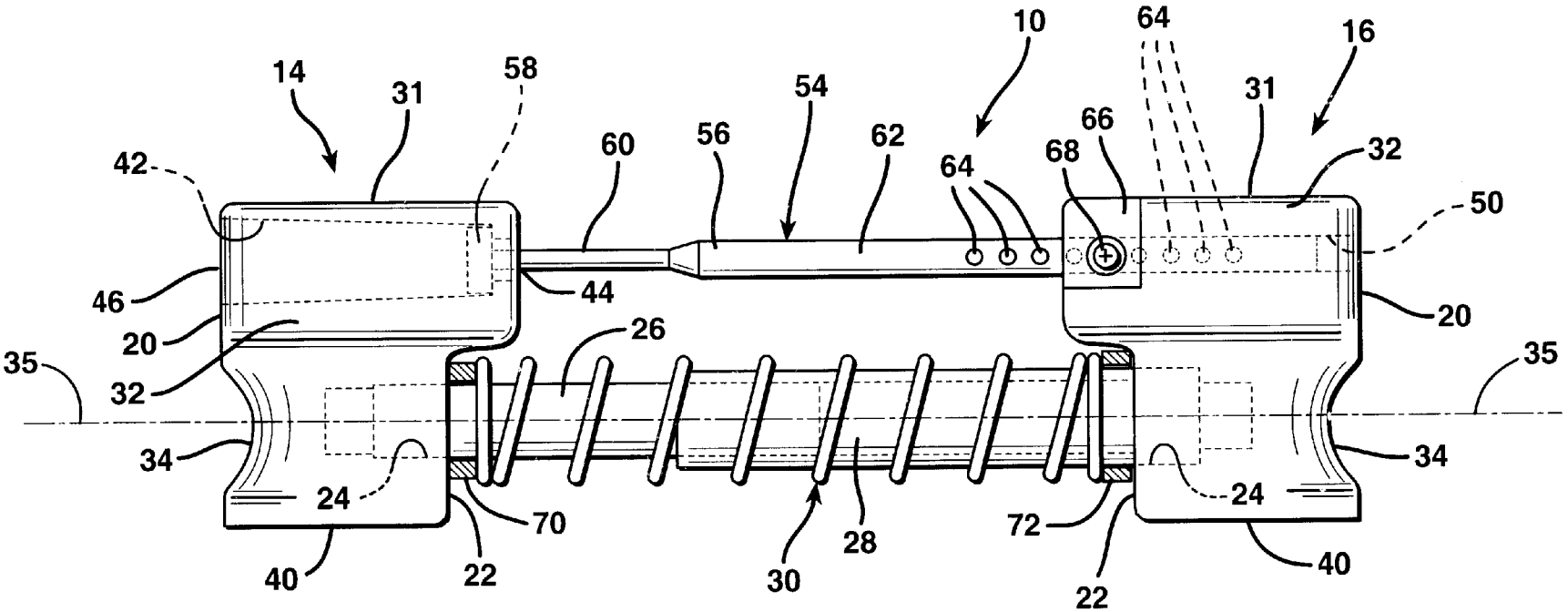
FIG. 5 is a side elevational view of the muscle exercising device as shown in the condition of FIG. 3.

The user thereupon repeatedly contracts and relaxes the facial muscles, alternatively compressing the coil spring 30 to the fully compressed condition illustrated in FIG. 5 and relaxing the facial muscles to allow the device to return to the extended position illustrated in FIGS. 3 and 4. The user repeats this muscle exercise for about 30 minutes each day. Because the outer sides 20 of the lip-engaging pieces 14 and 16 that contact the corners of the user's mouth are curved convex outwardly, they do not make the users mouth sore like conventional devices. Also, since the users lips are seated in the grooves 34, the facial muscle exercising device 10 will not pop out of the users mouth. The user is thereby more apt to use the facial muscle exercising device 10 on a regular regimen of exercise than is the case with conventional devices.

Figure 7:
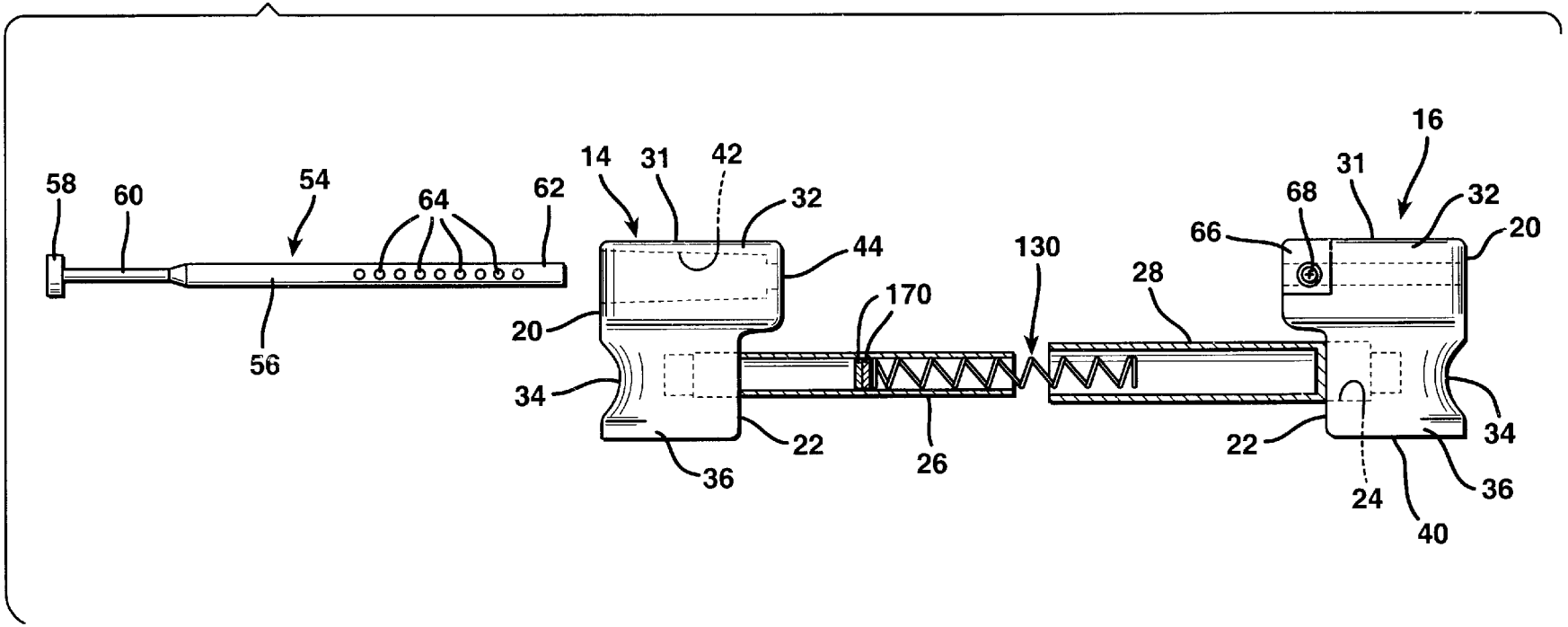
FIG. 7 is a partially exploded view, shown in partial section, of an alternative embodiment of a facial muscle exercising device to that illustrated in FIGS. 1–7.

FIG. 7 illustrates an alternative embodiment of the invention which is similar in many respects to the embodiment illustrated and described in conjunction with FIGS. 16. The embodiment of FIG. 7 differs, however, in that the spring 130 shown therein is not disposed externally about both of the spreader members formed by the coaxial tubes 26 and 28. Rather, the spring 130 has a diameter smaller than the inner diameter of the hollow inner tube 26 and is positioned therewithin fully encapsulated within the radial confines of the inner tube 26, as well as the outer tube 28. In this embodiment one or more disc-shaped spacer members 170 may be encapsulated within the inner confines of the hollow inner tube 26 and interposed between the coil spring 130 and at least one of the lip-engaging members 14 and/or 16.

Undoubtedly, numerous variations and modifications of the invention will become readily apparent to those familiar with facial muscle exercising devices. Accordingly, the scope of the invention should not be construed as limited to this specific embodiment depicted and described, but rather is defined in the claims appended hereto.

I claim:

1. A facial muscle exercising apparatus for insertion between the lips of a person's mouth comprising:

a pair of lip-engaging members disposed in longitudinal separation from each other and having mutually opposing convex outwardly curved sides and mutually facing sides, a pair of elongated coaxially aligned telescopically engaged spreader members, each anchored to a separate one of said mutually facing sides of said lip-engaging members, and an axially compressible coil spring having opposing ends and disposed in coaxial alignment with said spreader members so that said opposing ends bear against said mutually facing sides of said lip-engaging members.

2. A facial muscle exercising apparatus according to claim 1 wherein a guideway is defined in at least one of said lip-engaging members and an elongated guide member oriented parallel to said spreader members is engaged for reciprocation in said guideway in said one of said lip-engaging members and is secured to said other of said lip-engaging members.

3. A facial muscle exercising apparatus according to claim 2 wherein said elongated guide member is provided with a plurality of longitudinally separated recesses and said other of said lip-engaging pieces has a releaseable catch member transversely aligned relative to said guide member and engaged in a selected one of said recesses to immobilize said elongated guide member relative to said other of said lip-engaging members.

4. A facial muscle exercising apparatus according to claim 1 wherein said coil spring is disposed externally about both said spreader members.

5. A facial muscle exercising apparatus according to claim 1 wherein said spreader members are formed as hollow tubes with said coil spring encapsulated therewithin.

6. A facial muscle exercising apparatus according to claim 5 further comprising at least one spacer member encapsulated within said hollow tubes and interposed between said coil spring and at least one of said lip-engaging members.

7. A facial muscle exercising apparatus according to claim 1 wherein grooves having a concave cross section are defined in said convex outwardly curved sides of said lip-engaging members and said grooves are aligned to extend parallel to the coaxial alignment of said telescopically engaged spreader members.

8. A facial muscle exercising device comprising:

a pair of end pieces having curved convex outwardly facing opposing end sides facing away from each other, and defining opposing, longitudinally aligned sockets that face toward each other, a pair of rigid tubes including a narrower diameter inner tube and a hollow, annular outer tube that receives said inner tube therewithin in coaxial, telescopic engagement therewith, and said inner tube is seated in said socket of one of said end pieces and said outer tube is seated in said socket of the other of said end pieces, and a coil spring disposed in coaxial arrangement with said telescopically engaged tubes and having opposing ends that bear against said end pieces to bias them apart from each other.

9. A facial muscle exercising device according to claim 8 wherein said tubes have a common, straight linear axis of alignment and further comprising a straight, elongated guide member having opposing free and anchored ends, a guideway defined in one of said end of members to receive said free end of said guide member in reciprocal engagement therewith, and a catch mechanism in said other end piece releaseably engageable with said anchored end of said guide member at different locations along its length.

10. A facial muscle exercising device according to claim 8 wherein said free end of said elongated guide member has an end piece-engaging lug at its extremity that is brought into abutment against said one of said end pieces when said coil spring forces said end pieces to a maximum distance of separation from each other.

11. A facial muscle exercising apparatus comprising:

a pair of opposing lip-engaging pieces having mutually facing inner sides and opposing convex outwardly curved outer sides having longitudinally aligned concave grooves defined therein to receive the lips of the user at the corners where said lips meet, and wherein a guide passageway is defined through each of said lip-engaging pieces, and said passageway through one of said lip-engaging pieces has openings at said inner and outer sides thereof and said opening at said inner side is of reduced cross-sectional area from said opening at said outer side so that an internal abutment ledge directed toward said outwardly facing side is defined within the structure of said one of said lip-engaging pieces, a guide member having a longitudinally elongated shank with opposing ends that is received within said the guide passageways, and said guide member has an enlarged lug at one of said ends of said shank which is disposed outboard from said abutment ledge, and said other of said lip-engaging pieces has a releaseable locking member for engaging said other end of said guide member shank at a selected location along the length of said other end of said guide member shank, a pair of coaxial telescoping tubes, each one of which is secured to a separate one of said inner sides of said pair of lip-engaging pieces, and said guide passageways are parallel to the alignment of said coaxial tubes, and a coil spring coaxially engaged relative to said telescoping tubes for compression between said inner sides of said lip-engaging pieces to bias said lip-engaging pieces apart from each other.

12. A facial muscle exercising apparatus according to claim 11 wherein said other end of said guide member shank has a plurality of locking openings defined therein along its length and said releaseable locking member is a set screw that is engageable in said other of said lip-engaging pieces to project into a selected one of said locking openings.

13. A facial muscle exercising apparatus according to claim 11 wherein said guide member has a neck of reduced diameter adjacent said enlarged lug.

14. A facial muscle exercising apparatus comprising:

a pair of opposing lip-engaging pieces having mutually facing inner sides and opposing convex outwardly curved outer sides, a pair of coaxial telescoping tubes, each one of which is secured to a separate one of said inner sides of said pair of lip-engaging pieces, a coil spring coaxially engaged relative to said telescoping tubes for compression between said inner sides of said lip-engaging pieces to bias said lip-engaging pieces apart from each other, a guideway defined in at least one of said lip-engaging pieces extending parallel to said telescoping tubes, and a rigid guide member engaged in said at least one guideway for reciprocal movement therein and said guide member is secured to the other of said lip-engaging pieces.

15. A facial muscle exercising apparatus according to claim 14 further comprising a guideway also defined in said other of said lip-engaging pieces and said guideways in said lip-engaging pieces are longitudinally aligned with each other and said guide member includes a plurality of longitudinally s paced locking openings therein and further comprising a releaseable locking member on said other of said lip-engaging pieces alternatively engageable in a selected one of said longitudinally spaced locking openings.

16. A facial muscle exercising apparatus comprising:

a pair of opposing lip-engaging pieces having mutually facing inner sides and opposing convex outwardly curved outer sides, a pair of coaxial telescoping tubes, each one of which is secured to a separate one of said inner sides of said pair of lip-engaging pieces, a coil spring coaxially engaged relative to said telescoping tubes for compression between said inner sides of said lip-engaging pieces to bias said lip-engaging pieces apart from each other, and wherein said coil spring is disposed coaxially within the surrounding confines of said telescoping tubes.

17. A facial muscle exercising apparatus according to claim 16 further comprising at least one spacing lug interposed between said coil spring and at least one of said lip-engaging pieces to selectively control the extent of compression of said coil spring with changes in distance of separation between said lip-engaging pieces.

* * * * *